US006457538B1

(12) United States Patent
Pittard et al.

(10) Patent No.: US 6,457,538 B1
(45) Date of Patent: Oct. 1, 2002

(54) ADVANCED CORING APPARATUS AND METHOD

(75) Inventors: Gerard T. Pittard; J. Christopher Hetmaniak; Curtis Leitko; William J. Mcdonald, all of Houston, TX (US)

(73) Assignee: Maurer Engineering, Inc., Houston, TX (US)

( * ) Notice: Subject to any disclaimer, the term of this patent is extended or adjusted under 35 U.S.C. 154(b) by 18 days.

(21) Appl. No.: 09/789,309

(22) Filed: Feb. 20, 2001

Related U.S. Application Data

(60) Provisional application No. 60/185,636, filed on Feb. 29, 2000.

(51) Int. Cl.[7] ..... E21B 25/10; E21B 47/18

(52) U.S. Cl. ..... 175/46; 175/244

(58) Field of Search ..... 175/40, 44, 46, 175/58, 250, 252, 253, 254, 256; 340/853.1, 853.3, 853.5, 854.4, 854.6; 73/864.44, 864.45, 152.43, 152.03, 152.28, 152.46, 152.49, 153

(56) References Cited

U.S. PATENT DOCUMENTS 4,735,269 A * 4/1988 Park et al. ..... 175/244
4,955,438 A * 9/1990 Juergens et al. ..... 166/64
5,010,765 A * 4/1991 Duckworth et al. ..... 175/40
6,006,844 A * 12/1999 Van Puymbroeck et al. ..... 175/246
6,009,960 A 1/2000 Leitko, Jr. et al.

* cited by examiner

*Primary Examiner*—David Bagnell
*Assistant Examiner*—T. Shane Bomar
(74) *Attorney, Agent, or Firm*—Kenneth A. Roddy

(57) ABSTRACT

A system of apparatus for use in a coring tool measures the height of a core sample being recovered and transmits data relative thereto to the surface of a formation concurrently during the coring operation. A transmitter of an electromagnetic ranging system rides atop a core sample being formed in the barrel chamber and a receiver member of the electromagnetic ranging system is fixed at a top end of the barrel it known distance above the transmitter. During the coring operation the transmitter transmits a fixed frequency signal to the receiver through drilling fluid disposed therebetween. The distance between the transmitter and receiver decreases and the amplitude of the transmitted signal changes as a function of the separation distance between the transmitter and receiver as the core sample enters the inner barrel and the height of the core sample within the barrel is determined as a function of time and depth. The pressure of the drilling fluid is modulated to transmit a series of pressure pulses from the barrel to the surface encoded to produce a binary digital or pulse-width modulation signal. The electromagnetic ranging system may be incorporated into a coring tool having a core bit disposed at a lower end and a full closure ball valve and core retention assembly movable to a closed position to close the bottom end of the inner barrel and prevent the loss of core collected in the inner barrel chamber.

25 Claims, 5 Drawing Sheets

Change in Signal Amplitude with Distance

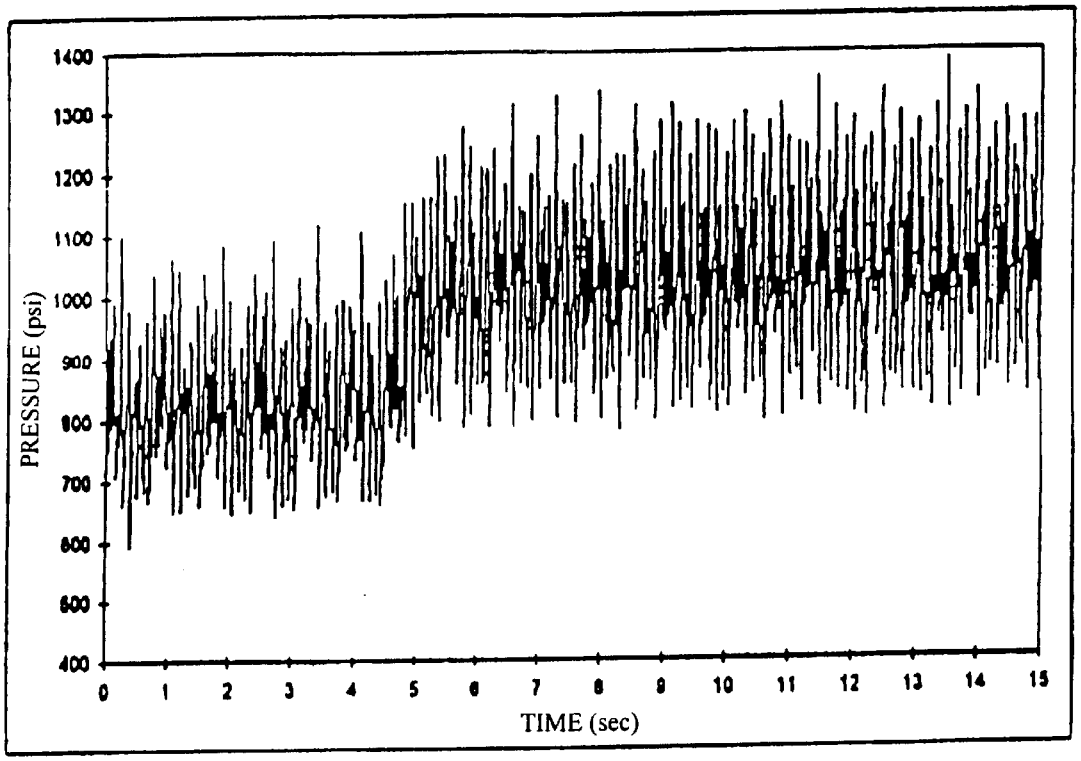
*Fig. 6* Raw Pressure Data.
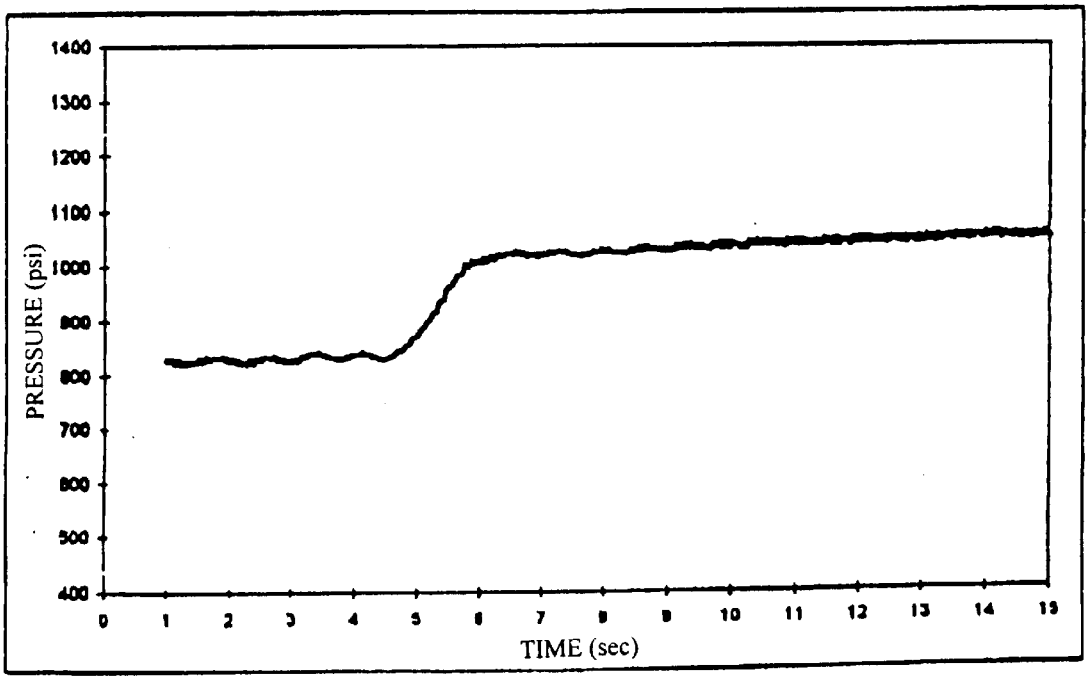
*Fig. 7* Smoothed Pressure Data

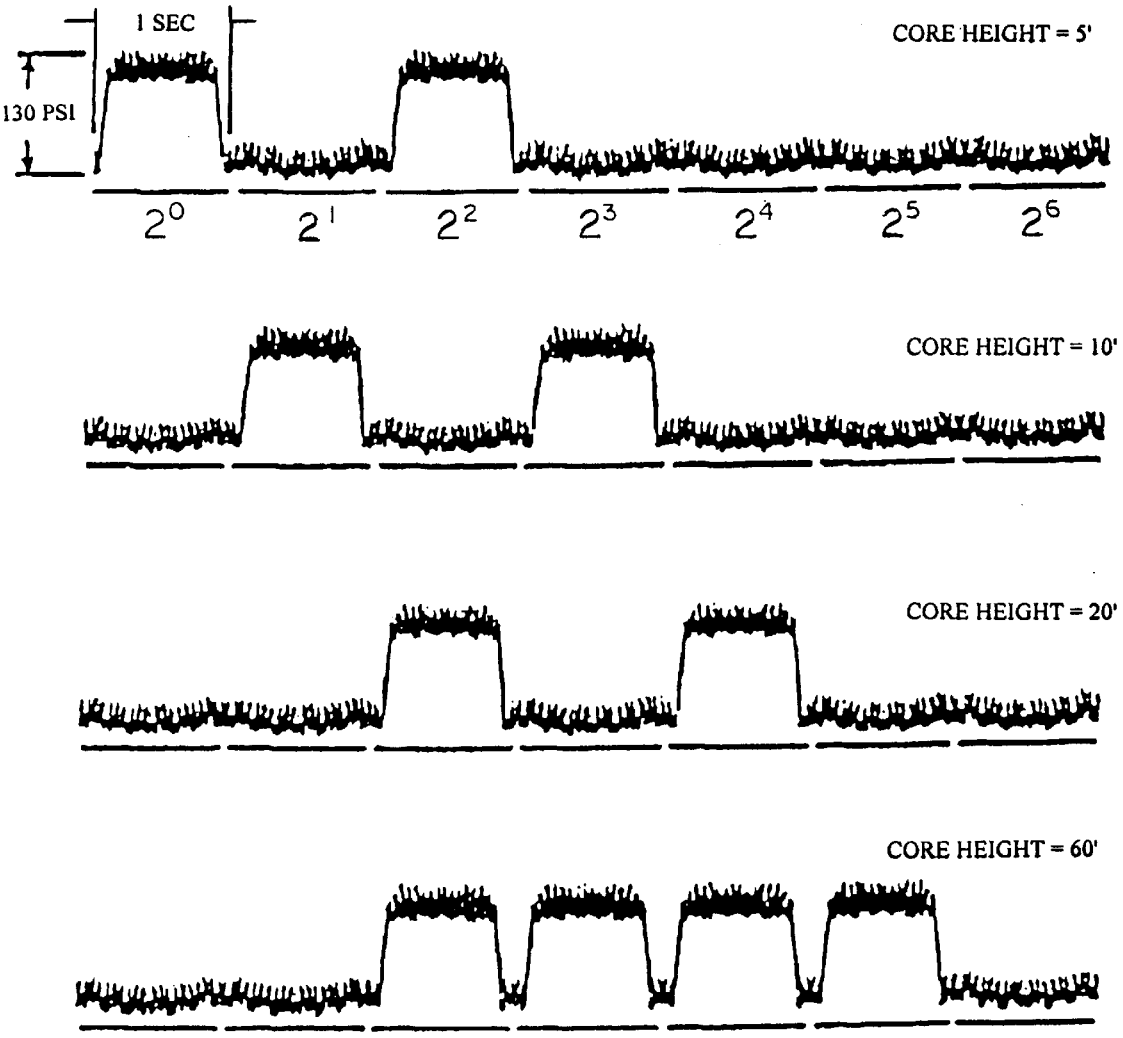
*Fig. 8* Pressure Pulse Encoding Patterns for Various Core Heights

CLOSED POSITION

OPEN POSITION

ADVANCED CORING APPARATUS AND METHOD

CROSS-REFERENCE TO RELATED APPLICATION

This application claims priority of U.S. Provisional Patent Application Ser. No. 60/185,636, filed Feb. 29, 2000. +gi

STATEMENT AS TO FEDERALLY SPONSORED RESEARCH

The invention described herein was made in the performance of work funded in part by Phase II of Small Business Innovation Research Grant No. DMI-9900706 sponsored by The National Science Foundation. The government may have certain rights in this invention.

BACKGROUND OF THE INVENTION

1. Field of the Invention

This invention relates generally to wellbore core sampling apparatus and methods, and more particularly to an advanced coring system and method utilizing a core height measurement module that accurately measures the amount of core captured as a function of time and depth, a data telemetry-module that conveys this information to the surface in real time, and a full closure valve assembly that completely closes the bottom of the core barrel under surface control to prevent loss of unconsolidated and highly fractured cores.

2. Brief Description of the Prior Art

The taking of core samples is the most accurate means to evaluate rock properties for hydrocarbon and ore body development, scientific investigation and environmental clean up activities. Conventional coring methods and apparatus have two major shortcomings: (1) the absence of real-time monitoring of the core length (recovery) in the core barrel, and (2) the lack of complete closure of the core barrel opening to prevent core loss. While partial or complete core loss is generally not a problem in competent formations, it is an important problem in unconsolidated and highly fractured ones. A review of U.S. and Canadian coring activities showed that partial core loss is experienced in approximately 20% of the wells cored. This lost core translates into considerable costs—particularly in offshore drilling operations where rig rates can run in excess of $10,000 per hour. Of even greater potential importance is the loss of geologic information.

It is extremely important to recover the entire interval where the rock is being cored. If any core is not recovered, valuable information is lost. Coring operations are performed under a wide range of operating conditions. These include: (1) variation in wellbore inclination angle from zero (vertical) to ninety degrees (horizontal), (2) use of wide range of drilling fluids such as water and oil-based mixtures, nitrooelltited muds, and air/foam mists, (3) encountering zones of lost circulation and (4) rapid changes in lithology. The net result of these conditions in the standard coring process introduces uncertainties which occur because standpipe pressure, pump speed, mud weight and drill cutting returns (among other things) at the surface are used to "assess" the progress of the coring operation. None of these parameters are direct measures of the amount of core actually being recovered in the barrel. The present invention eliminates these uncertainties by providing a real-time monitoring device.

The monitoring feature of the present system accurately measures the amount of core captured as a function of time and depth, and conveys this information to the surface in real combined with the ability to completely close the bottom of the core barrel under surface control and prevent loss of unconsolidated and highly fractured cores, the present system will improve coring success and reduce overall coring costs.

The present invention provides new hardware modules for core height measurement and core barrel closure that are compatible with conventional and wireline-retrievable coring systems. This present system also does not require any changes to the standard inner and outer core barrel assemblies and it operates with both sealed oil-lubricated and mud-lubricated bearing packs.

A suitable ball valve assembly for use with the present invention is disclosed in U.S. Pat. No. 6,009,960 titled Coring Tool, issued Jan. 4, 2000 and assigned to Diamond Products International, Inc., of Houston, Tex., which is hereby incorporated by reference to the same extent as if fully set forth herein. U.S. Pat. No. 6,009,960 does not disclose the present electromagnetic ranging system for core height measurement as a function of time and depth, or the present data telemetry system that conveys this information to the surface in real time, however, preliminary testing of the combination utilizing such a valve assembly has proven satisfactory.

The present invention is distinguished over the prior art in general by an advanced coring system and method utilizing a core height measurement module that accurately measures the amount of core captured as a function of time and depth, a data telemetry module that conveys this information to the surface in real time, and a full closure valve assembly that completely closes the bottom of the core barrel under surface control to prevent loss of unconsolidated and highly fractured cores. The transmitter of the electromagnetic ranging system rides atop a core sample being formed in the barrel chamber and a receiver member of the electromagnetic ranging system is fixed at a top end of the barrel a known distance above the transmitter. During the coring operation the transmitter transmits a fixed frequency signal to the receiver through drilling fluid disposed therebetween. The distance between the transmitter and receiver decreases and the amplitude of the transmitted signal changes as a function of the separation distance between the transmitter and receiver as the core sample enters the inner barrel and the height of the core sample within the barrel is determined as a function of time and depth. The pressure of the drilling fluid is modulated to transmit a series of pressure pulses from the barrel to the surface encoded to produce a binary digital or pulse-width modulation signal. The electromagnetic ranging system may be incorporated into a coring tool having a core bit disposed at a lower end and a full closure ball valve and core retention assembly movable to a closed position to close the bottom end of the inner barrel and prevent the loss of core collected in the inner barrel chamber.

SUMMARY OF THE INVENTION

It is therefore an object of the present invention to provide an advanced coring system and method which will eliminate uncertainties that may occur due to variations in standpipe pressure, pump speed, mud weight and drill cutting returns, among other things.

It is another object of this invention to provide an advanced coring system and method utilizing a core height measurement module that produces direct accurate measurement of the amount of core actually being recovered in the barrel of the coring tool.

Another object of this invention is to provide an advanced coring system and method that conveys accurate core height data of the core being recovered in the barrel of the coring tool to the surface in real time.

Another object of this invention is to provide an advanced coring system and method that will prevent loss of unconsolidated and highly fractured cores.

Another object of this invention is to provide an advanced coring system and method utilizing core height measurement modules and core barrel closure modules that are compatible with conventional and wireline-retrievable coring systems.

A further object of this invention is to provide an advanced coring system and method utilizing core height measurement modules and core barrel closure modules that does not require any significant changes to standard inner and outer core barrel assemblies and will operate with both sealed oil-lubricated and mud-lubricated bearing packs.

A still further object of this invention is to provide an advanced coring system and method which will improve coring success and reduce overall coring costs.

Other objects of the invention will become apparent from time to time throughout the specification as hereinafter related.

The above noted objects and other objects of the invention are accomplished by an advanced coring system and method utilizing a core height measurement module that accurately measures the amount of core captured as a function of time and depth, a data telemetry module that conveys this information to the surface in real time, and a full closure valve assembly that completely closes the bottom of the core barrel under surface control to prevent loss of unconsolidated and highly fractured cores.

BRIEF DESCRIPTION OF THE DRAWINGS

FIG. 6 is a graph showing raw pressure data taken directly at the output of a triplex pump with the pulser set in an extended "On" position prior to processing the left side of the graph representing the pressure before the positive pressure pulse is initiated, and the right side representing the pressure change with some of the orifices closed.

FIG. 7 is a graph showing the raw pressure data processed with a 50 point moving average applied.

FIG. 8 is a graph illustrating the binary byte pressure patterns of encoded core heights in core barrels of 5, 10, 20 and 60 and feet; respectively.

DESCRIPTION OF THE PREFERRED EMBODIMENT

Figure 1:
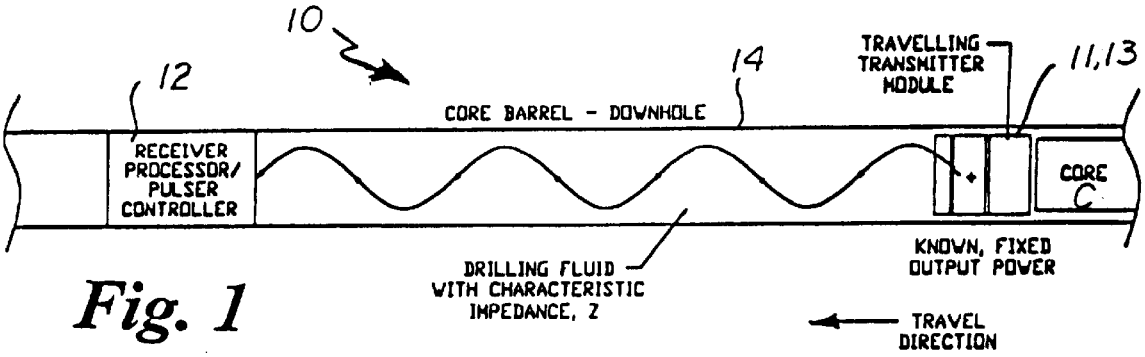
FIG. 1 is a schematic illustration of the electromagnetic core height measurement module.
Figure 2B:
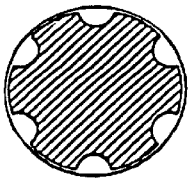
FIG. 2B is a schematic top plan view of the weighted fluted transmitter housing.
Figure 2A:
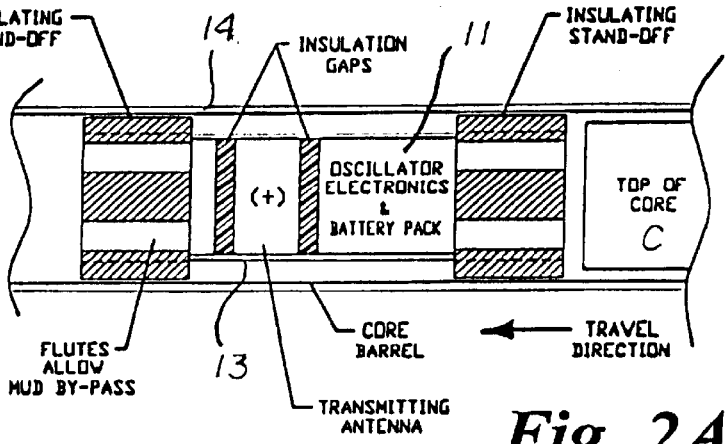
FIG. 2A is a schematic illustration of the weighted fluted transmitter housing that rides on the top of the core and contains the battery-powered data transmitter.

In the advanced coring system of the present invention core height measurement is made using an electromagnetic ranging system 10 comprising a matched transmitter 11 and receiver 12 pair, as schematically illustrated in FIGS. 1, 2A and 2B. The transmitter 11 with its associated electronics and oscillator circuitry and on-board battery power supply resides inside of a weighted fluted housing 13 (FIGS. 2A, 2B) which rides on the top of the core C as it moves upward through the inner core barrel 14 of a coring tool. The transmitter 11 outputs a fixed frequency signal whose operating parameters can be set prior to running into the hole. The matched receiver 12 is installed in a pup sub directly above the top of the core barrel. The matched receiver 12 has a filter and level detection circuit capable of measuring the received amplitude of the transmitted signal. The signal amplitude changes in a well-defined manner, with the separation distance between the receiver 12 and transmitter 11 providing a direct measurement of the core height.

Figure 3:
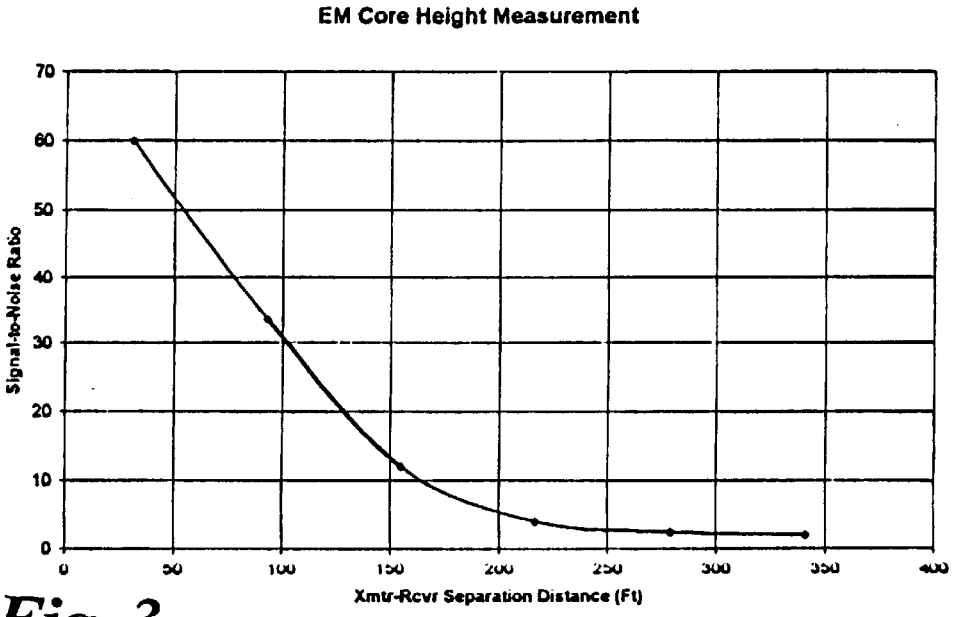
FIG. 3 is a graph showing the signal-to-noise ratio as a function the separation distance obtained in a typical coring operation.

FIG. 3 shows the signal-to-noise ratio as a function the separation distance obtained in a typical coring operation. The change in signal strength versus separation distance is quite steep over the first 150 feet. This behavior allows accurate core height measurements to he made since small changes in distance produce relatively large changes in signal strength. A beneficial aspect of this approach is that the core height measurement can be self calibrated for use in different drilling fluids or muds by taking a short series of readings directly below the rotary table in the fluid filled hole.

The receiver 12 includes an on-board analog-to-digital (A/D) converter connected with the level detection circuit and a micro-controller or microprocessor. The signal strength reading is taken from the A/D converter and processed by the on-board microprocessor. The micro-controller converts the signal level into core height data and sends this information to the surface by controlling the operation of a mud pulse telemetry system.

Unlike conventional mud pulse telemetry of downhole sensor data to the surface employed in many modern measurement-while-drilling and logging-while-drilling instrumentation systems, the present system provides real-time core height monitoring in a simple, low cost, highly reliable unit.

Three options are available for modulating the pressure of the drilling fluid to encode and transmit data from the well bottom to the surface. These are the creation of positive, negative or variable frequency pressure pulses. The first two approaches selectively vary the cross sectional flow area available for the drilling fluid to momentarily change pressure and, by creating a series of these events, produce a binary digital or pulse-width modulation encoding scheme. The third system consist of a spinning vane or disc assembly whose rate of rotation can be selectively retarded to support frequency shift keying (FSK) encoding.

Figure 4:
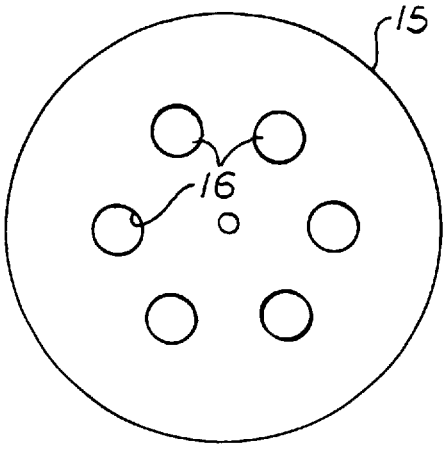
FIG. 4 is a top plan view of the orifice plate of the mud pulser unit employed in the present invention.

The preferred mud pulse unit 15 employed in the advanced coring system is a multi-orifice positive-pressure pulse design, as seen in FIG. 4, disposed in the drilling fluid path. The drilling fluid entering the pup sub located directly above the core barrel assembly is forced to flow through a six nozzle orifice plate 15. The nozzles or orifices 16 in this plate can be individually sized to support a wide range of flow rates and produce a given pressure drop. One or more of the nozzles 16 can be selectively opened and closed to modulate the pressure of the drilling fluid. Opening and closing of the nozzles is controlled by the microprocessor in the receiver 12 to reduce the flow area therethrough and create a series of positive-pressure pulses corresponding to the amplitude of the transmitted signal changes. For example, two of the six nozzles can be momentarily closed to increase pressure from 50 to 250 psi above normal standpipe pressure. Table 2 below, shows the flow rates for various core barrel sizes.

Tests have been carried out using a 6¾"×4"×90' coring tool rated at 10.000 psi capable of collecting 4 inch diameter cores up to 90 feet in length (accuracy ±½ feet) and using conventional coring hardware with conventional oil and water based drilling fluids and operating at a maximum depth of 18,000 feet. The tool was equipped with the core height measurement module, the data telemetry module, and the full closure valve assembly described hereinafter. The tool had a temperature rating of 150° C. and at minimum battery life of 50 hours. Tests were conducted using positive-pressure mud pulse data telemetry with transmission triggers wherein information was sent on first satisfied time or distance criteria. The coring tool was sized to support the normal range of mud flows used to cut 4 inch diameter cores which is 200 to 340 gallons per minute (gpmii) as shown in Table 2.

TABLE 2

Flow Rates For Various Core Barrel Sizes

| Hole Size (Inches) | Barrel Size (Inches) | Flow Rate (GPM) |
|---|---|---|
| 4¾ | 3½ × 1¾ | 50–90 |
| 5½–6½ | 4 × 2 | 90–160 |
| 5¾–6¾ | 4¾ × 2 | 100–180 |
| 6–6¾ | 5¾ × 3½ | 150–250 |
| 7½–7 | 6¼ × 4 | 180–300 |
| 8–9 | 6¾ × 4 | 200–340 |
| 8½–9 | 7 × 4 | 220–370 |
| 9½–12¼ | 8¼× 5¼ | 225–450 |

Figure 5:
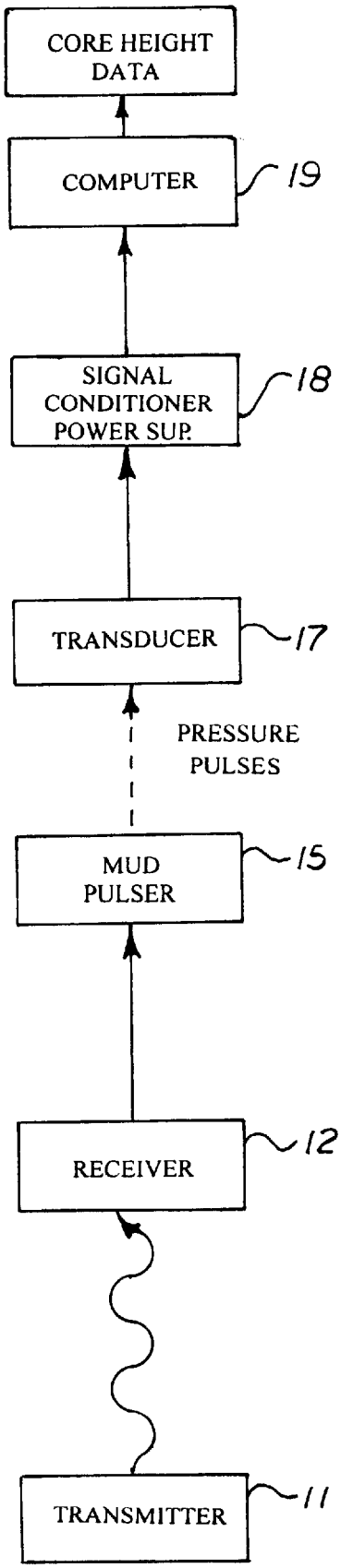
FIG. 5 is a schematic block diagram illustrating the signal transmitting process.

As shown schematically in FIG. 5, the pressure pulses move up the drill string sued are read using a 0–5000 psi, 4–20 mA pressure transducer 17 connected to the standpipe using a 1502 hammer union. The pressure transducer 17 is connected by way of a cable to a signal conditioning/power supply circuit 18 and a laptop computer 19. The computer 19 contains a 16-channel, high-speed data acquisition card, appropriate processing software, and a display for displaying core height in real time. The signal conditioner 18 modifies the output of the pressure transducer 17 to a form suitable for acquisition and processing by the computer 19.

One of the key features of the present mud pulse telemetry system is that it does not use pulsation dampers (accumulators), but instead takes event data directly out of the pump plunger noise through simple mathematical processing routines. FIG. 6 shows raw pressure data taken directly at the output of a triplex pump with the mud pulser set in an extended "On" position prior to processing. Tile left side of the graph shows the pressure before the positive pressure pulse is initiated, and the right side shows the pressure chance with some of the orifices closed. The pressure variations caused by the individual plunger strokes is nearly the same magnitude as the pressure change caused by the orifice closure. FIG. 7 shows the same raw data processed with a 50 point moving average applied. The transition from a low (binary value 0) to high state (binary value=1) is clear without the need for accumulators. The data were collected at a sample rate of 50 Hz.

Thus, the present mud pulser 15 is capable of creating pulses that ale repeatable in magnitude, duration and shape and therefore capable of supporting digital encoding. The digital,encoding scheme is relatively straightforward. FIG. 8 illustrates the binary byte pressure patterns of encoded core heights in core barrels of 5, 10, 20 and 60 feet, respectively.

The electrical circuitry of the transmitter and oscillator, the receiver, the signal filter and level detection circuit, the analog-to-digital converter, microprocessor the mud-pulse telemetry, and mud pulse transmitter and transducer is conventional in nature and readily apparent to those skilled in the art, and therefore not shown and described in detail.

Figure 9A:
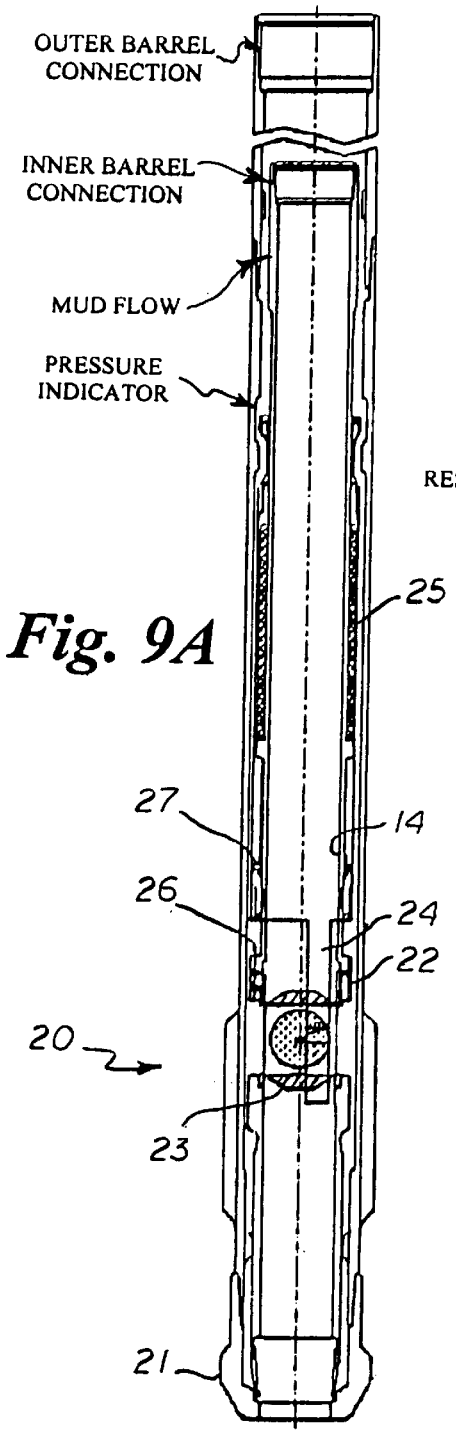
FIGS. 9A and 9B are longitudinal cross sections of the coring tool showing the spring-armed ball valve in a closed position and in an opened position, respectively.
Figure 9B:
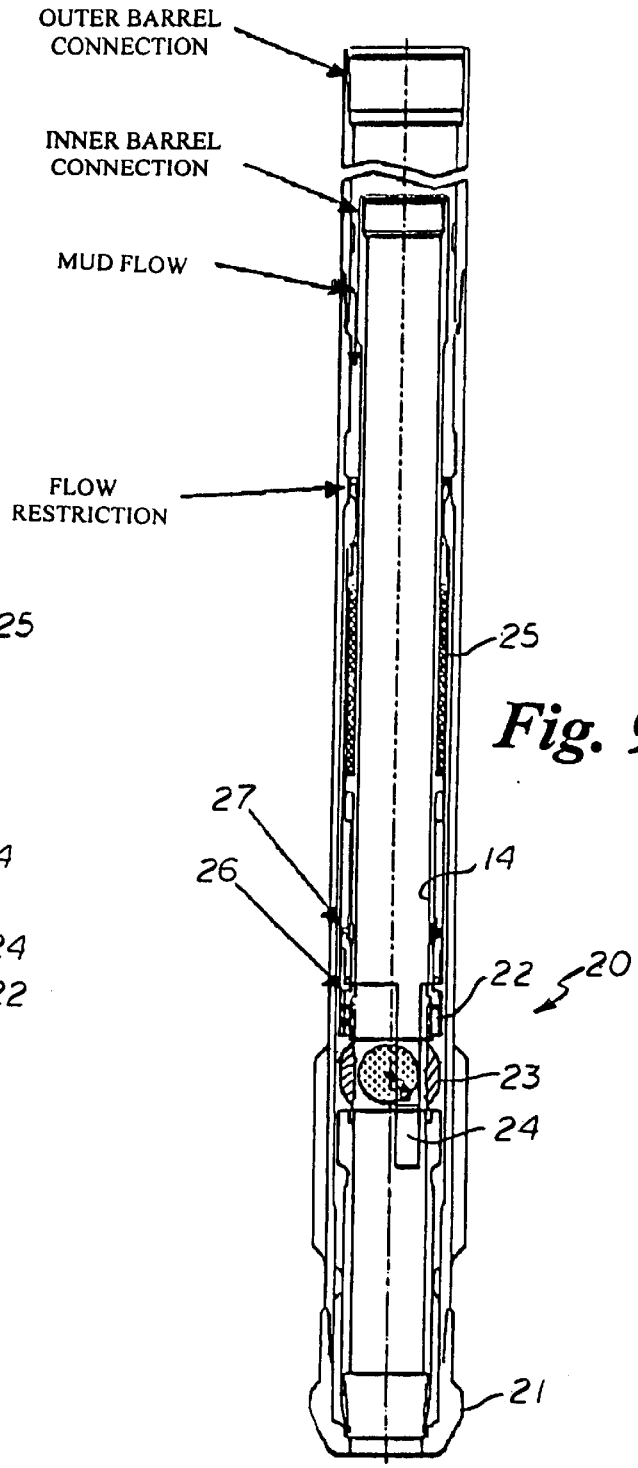

Referring now to FIGS. 9A and 9B, a spring-armed ball valve assembly 20 is disposed between the core bit 21 and the lower end of the core barrel 14 which closes the bottom of the core barrel after the maximum length of core has been captured. The ball valve assembly 20 shown somewhat schematically in FIGS. 9A, 9B. A suitable ball valve assembly for use is disclosed in U.S. Pat. No. 6,009,960 titled Coring Tool, issued Jan. 4, 2000 and assigned to Diamond Products International, Inc., of Houston, Tex., which is hereby incorporated by reference to the same extent as if fully set forth herein. U.S. Pat. No. 6,009,960 does not disclose the present electromagnetic ranging system for core height measurement as a function of time and depth, or the present data telemetry system that conveys this information to the surface in real time, however, preliminary testing of the combination utilizing such a valve assembly has proven satisfactory. This incorporation-by-reference is for the purpose of simplifying the drawings and descriptions of the preferred full closure valve assembly and providing a more comprehensive detailed description thereof. The reader may refer to the above patent for a more detailed description of particular structural components and operation of the full closure ball valve assembly.

The full closure ball valve and core retention assembly 20 has a tubular housing 22 securable to the inner tubular barrel 14 and has an inner bore disposed therethrough. A ball valve 23 is rotatably disposed in the housing 22 adjacent to the bottom end of the inner barrel 14 and is rotatable between a closed (FIG. 9A) and an open position (FIG. 9B). An actuator sleeve 24 keyed to the valve ball is slidably disposed on the housing to move between an upper (valve closed) and a lower position (valve open), and is normally biased in the upper (closed) position by a plurality of disc springs (Belleville springs) 25 longitudinally disposed about the tubular housing and operably engaged with the actuator sleeve 24. The bore of the valve ball 23, in the open (sleeve lower) position is aligned in communication with the inner barrel longitudinal chamber. The actuator sleeve 24, in its lower position, engages a stop shoulder 26 and alignment of a spring retainer ring 27 with a clearance groove releases the compression on the Belleville springs 25. The assembly includes means for locking the actuator sleeve 24 in the lower (valve open) position, and fluid actuated means to release the locking means so as to enable the actuator sleeve to move to the upper (valve closed) position, thereby moving the ball valve to a closed position whereby the inner barrel bottom end is closed to prevent the loss of core collected in the inner barrel chamber. A flow restriction is created when the actuator sleeve 24 is disposed in the upper (closed) position wherein fluid flow through the flow restriction is substantially increased when the sleeve is moved to the lower (open) position which is detectable by the operator and serves as a "telltale" for determining when the ball valve 23 is in a closed position.

The ball valve 23 (sleeve 24) is actuated under surface operator control such that the closure trigger is substantially away from normal operating conditions to prevent it from being tripped inadvertently. Once the ball valve has been tripped, it provides a clear indication or "tattletale" that it has closed properly.

In a preferred embodiment, the spring-armed ball valve 23 is caused to close by first momentarily increasing the drilling fluid flow rate above a pre-set operating level and then reducing the flow back to normal flow ranges. This provides ail absolute pressure indication when the ball valve has closed due to the significant difference in cross sectional flow areas between the open and closed states.

The actuation force required to rotate the ball valve closed is provided by the stacked series of Belleville springs 25 which have been compressed ("armed") at the surface prior to running into the hole using appropriate conventional tooling. The ball valve is in its full open position in the armed state. In the open state the ball valve has the same internal diameter as the drift diameter of the inner core barrel.

With the tool armed, the coring assembly is run into the hole, the bottom tagged, and coring operations commenced. For mud flow rates below the pre-set trigger point, the fluid pressure drop acting across a restriction inside the ball valve assembly 20 causes the actuator sleeve 24 to be pumped down towards, but not all the way to, the lower stop shoulder 26. For flows below the trigger flow, the movement is not enough to bring the spring retaining ring 27 into alignment with the clearance groove cut into the actuator nut. Thus, the ball valve 23 remains fully open at all flow rates below the trigger level.

When the desired length of core has been taken, the flow rate is brought to at level above the trigger flow for a period of about 30–60 seconds. In this case, the movement of the actuator sleeve 24 is now sufficient to pump the sleeve down to the stop shoulder 26 and align the spring retaining ring 27 with the clearance groove. This allows the spring retaining ring 27 to expand outward into the actuator housing. Then, by stopping the flow, the Belleville spring assembly 25 forces the actuator sleeve 24 away from the stop shoulder 26. Because the actuator sleeve 24 is mechanically keyed to the ball valve 293. this movement causes the ball valve to be rotated closed. The Belleville spring stack 25 generates a large closure force capable of shearing off the core and closing the inner barrel.

While this invention has been described fully and completely with special emphasis upon preferred embodiments, it should be understood that within the scope of the appended claims the invention may be practiced otherwise than as specifically described herein.

We claim:

1. A method for measuring the height of a core sample being recovered in a barrel of a coring tool and transmitting data relative thereto to the surface of a formation concurrently during a coring operation, comprising the steps of:

providing in the coring tool at least an inner barrel having an internal longitudinal chamber for accommodating a core sample;

providing a transmitter of an electromagnetic ranging system within a lower end of the barrel to ride atop a core sample being formed in the barrel chamber, and fixing a receiver member of the electromagnetic ranging system at a top end of the barrel a known distance above the transmitter;

introducing drilling fluid from the surface into the inner barrel between said transmitter and said receiver; and during the coring operation, transmitting a fixed frequency signal from said transmitter to said receiver through the drilling fluid therebetween; wherein the distance between said transmitter and said receiver decreases and the amplitude of the transmitted signal changes as a function of the separation distance between said transmitter and said receiver as the core sample enters the inner barrel and the height of the core sample within the barrel is determined as a function of time and depth; and transmitting a signal representing the core height depth to the surface of the formation.

2. The method according to claim 1, wherein said step of transmitting a fixed frequency signal from said transmitter to said receiver comprises:

detecting the amplitude of the transmitted signal changes with a level detection circuit;

converting the detected amplitude of the transmitted signal changes from an analog signal to a digital signal; and processing the digital signal into a data signal representing the core height.

3. The method according to claim 2, including the step of filtering the transmitted signal with a signal filter prior to detecting the amplitude of the transmitted signal changes.

4. The method according to claim 1, wherein said step of transmitting a signal representing the core height depth to the surface of the formation comprises:

modulating the pressure of the drilling fluid using mud-pulse telemetry to transmit a series of pressure pulses from the barrel to the surface encoded to produce a binary digital or pulse-width modulation signal.

5. The method according to claim 4, wherein said step of modulating the pressure of the drilling fluid using mud-pulse telemetry comprises:

forcing the drilling fluid through a multiple nozzle orifice plate, at least one of which nozzles is selectively opened and closed to reduce the flow area therethrough and create a series of positive-pressure pulses.

6. The method according to claim 5, wherein the opening and closing of at least one of said nozzles of said multiple nozzle orifice plate is controlled by a microprocessor in said receiver corresponding to the amplitude of the transmitted signal changes.

7. The method according to claim 1, comprising the step of calibrating the signal strength of the electromagnetic ranging system relative to the separation distance between said transmitter and said receiver for use with the particular drilling fluid being used by taking several readings of the change in signal strength when said barrel, said transmitter and said receiver are disposed at an upper end of a borehole of the formation filled with the drilling fluid.

8. The method according to claim 1, comprising the step of selecting a frequency for use as the frequency of the fixed frequency signal that will minimize electromagnetic attenuation and shielding effects of said inner barrel when formed of metallic material and is disposed in an outer core barrel formed of metallic material.

9. A system of apparatus for use in a coring tool to measure the height of a core sample being recovered and transmitting data relative thereto to the surface of a formation concurrently during a coring operation, comprising:

an inner barrel adapted to be received in the coring tool and having, an internal longitudinal chamber for accommodating a core sample;

a transmitter of an electromagnetic ranging system movably disposed within a lower end of the barrel to ride atop a core sample being formed in said barrel chamber, and a receiver member of the electromagnetic ranging system fixed it a top end of said barrel a known distance above said transmitter wherein a quantity of drilling fluid introduced from the surface into said inner barrel is disposed between said transmitter and said received said transmitter during the coring operation, transmitting a fixed frequency signal from said transmitter to said receiver during the coring operation through said drilling fluid therebetween; and wherein the distance between said transmitter and said receiver decreases and the amplitude of the transmitted signal changes as a function of the separation distance between said transmitter and said receiver as the core sample enters said inner barrel and the height of the core sample within the barrel is determined as a function of time and depth.

10. The system of apparatus according to claim 9, wherein said receiver includes a signal level detection circuit for detecting the amplitude of said transmitted signal changes;

an analog-to-digital converter connected with said level detection circuit for converting the detected amplitude of said transmitted signal changes from an analog signal to a digital signal; and a microprocessor connected with said analog-to-digital circuit for processing the digital signal into a data signal representing the core height.

11. The system of apparatus according to claim 10, wherein said receiver includes a signal filter connected with said signal level detection circuit for filtering the signal transmitted by said transmitter.

12. The system of apparatus according to claim 10, further comprising:

signal transmitting means connected with said microprocessor for transmitting a signal representing the core height depth to the surface of the formation.

13. The system of apparatus according to claim 12, wherein said signal transmitting means comprises means for modulating the pressure of the drilling fluid using mud-pulse telemetry to transmit a series of pressure pulses from said barrel to the surface that are encoded to produce a binary digital or pulse-width modulation signal.

14. The system of apparatus according to claim 13, further comprising:

a pressure transducer disposed in the drilling fluid path above said barrel for detecting said pressure pulses, said pressure transducer producing a pressure measurement in response to said pressure pulses;

a computer at the surface of the formation including data acquisition means processing software, and display means for displaying core height data in real time; and a signal conditioner and power supply circuit interposed between said pressure transducer and said computer, said signal conditioner modifying the output of said pressure transducer to a form suitable for acquisition and processing by said computer.

15. The system of apparatus according to claim 13, wherein said means for modulating the pressure of the drilling fluid comprises a multiple nozzle orifice plate disposed in the drilling fluid path, and having at least one nozzle controlled by said microprocessor to be selectively opened and closed to reduce the flow area therethrough and create a series of positive-pressure pulses corresponding to the amplitude of the transmitted signal changes.

16. A subterranean formation coring apparatus, comprising:

a tubular outer barrel including structure at an upper end thereof for connection to a drill string, and defining a longitudinal bore;

a core bit disposed at a lower end of the tubular barrel;

an inner barrel housed in said outer barrel and having an internal longitudinal chamber for accommodating a core sample; and electromagnetic ranging instrumentation operable to obtain data relating to at least the height of a core sample being recovered and transmit data relative thereto to the surface of a formation concurrently during a coring operation, wherein the electromagnetic ranging instrumentation includes a transmitter movably disposed within a lower end of said inner barrel to ride atop a core sample being formed in said barrel chamber and a receiver fixed at a top end of said inner barrel a known distance above said transmitter wherein a quantity of drilling fluid introduced from the surface into said inner barrel is disposed between said transmitter and said receiver;

said transmitter transmitting a fixed frequency signal from said transmitter to said receiver during the coring operation through said drilling fluid therebetween wherein the amplitude of the transmitted signal changes as a function of the separation distance between said transmitter and said receiver as the core sample enters said inner barrel and the height of the core sample within the barrel is determined as a function of time and depth.

17. The coring apparatus according to claim 16, wherein said receiver includes a signal level detection circuit for detecting the amplitude of said transmitted signal changes;

an analog-to-digital converter connected with said level detection circuit for converting the detected amplitude of said transmitted signal changes from an analog signal to a digital signal; and a microprocessor connected with said analog-to-digital circuit for processing the digital signal into a data signal representing the core height.

18. The coring apparatus according to claim 17, wherein said receiver includes a signal filter connected with said signal level detection circuit for filtering the signal transmitted by said transmitter.

19. The coring apparatus according to claim 17, further comprising:

signal transmitting means connected with said microprocessor for transmitting a signal representing the core height depth to the surface of the formation.

20. The system of apparatus according to claim 19, wherein said signal transmitting means comprises means for modulating the pressure of the drilling fluid using mud-pulse telemetry to transmit a series of pressure pulses from said barrel to the surface that are encoded to produce a binary digital or pulse-width modulation signal.

21. The coring apparatus according to claim 20, further comprising:

a pressure transducer disposed in the drilling fluid path above said inner barrel for detecting said pressure pulses, said pressure transducer producing a pressure measurement in response to said pressure pulses;

a computer at the surface of the formation including data acquisition means processing software, and display means for displaying core height data in real time; and a signal conditioner and power supply circuit interposed between said pressure transducer and said computer, said signal conditioner modifying the output of said pressure transducer to a form suitable for acquisition and processing by said computer.

22. The coring apparatus according to claim 20, wherein said means for modulating the pressure of the drilling fluid comprises a multiple nozzle orifice plate disposed in the drilling fluid path, and having at least one nozzle controlled by said microprocessor to be selectively opened and closed to reduce the flow area therethrough and create a series of positive-pressure pulses corresponding to the amplitude of the transmitted signal changes.

23. The coring apparatus according to claim 16, further comprising:

a full closure ball valve and core retention assembly including a tubular body securable to said inner tube at its upper end and having an inner bore disposed therethrough, said body defining a housing for receiving a ball closure valve;

an actuator sleeve slidably disposed on said body between an upper and a lower position, said sleeve operably engaged with said ball closure valve and being normally biased in said upper position by biasing means;

a ball valve rotatably disposed in said housing adjacent to a bottom end of said inner barrel and rotatable between an open and a closed position said ball having a bore disposed therethrough which, in the open position corresponding to said lower position of said sleeve, is in communication with said inner barrel longitudinal chamber;

means for locking said actuator sleeve in said lower position; and fluid actuated means to release said locking means so as to enable said actuator sleeve to move to said upper position, thereby moving said ball valve to a closed position whereby said inner barrel bottom end is closed to prevent the loss of core collected in said inner barrel chamber, and means to vary the force necessary to unlock said actuator sleeve.

24. The coring apparatus according to claim 23, wherein said biasing means includes a plurality of disc springs longitudinally disposed about said tubular body and operably disposed with said actuator sleeve.

25. The coring apparatus according to claim 16, further comprising:

means detectable by an operator for determining when the ball valve is in a closed position, including a flow restriction created when said actuator sleeve is disposed in in upper position wherein fluid flow through said flow restriction is substantially increased when said sleeve is moved to said lower position.

* * * * *